US009173448B1

(12) United States Patent
Knoblauch

(10) Patent No.: US 9,173,448 B1
(45) Date of Patent: Nov. 3, 2015

(54) WRESTLING SHOE ASSEMBLY THAT INCLUDES AN AUXILIARY OVERSHOE

(76) Inventor: Eric Knoblauch, Newtown, PA (US)

( * ) Notice: Subject to any disclaimer, the term of this patent is extended or adjusted under 35 U.S.C. 154(b) by 746 days.

(21) Appl. No.: 13/347,135

(22) Filed: Jan. 10, 2012

Related U.S. Application Data

(60) Provisional application No. 61/431,399, filed on Jan. 10, 2011.

(51) Int. Cl.

| | |
|---|---|
| ***A43B 13/12*** | (2006.01) |
| ***A43B 13/18*** | (2006.01) |
| ***A43B 5/00*** | (2006.01) |
| ***A43B 23/08*** | (2006.01) |
| ***A43B 5/12*** | (2006.01) |
| ***A43B 13/22*** | (2006.01) |

(52) U.S. Cl.
CPC ... *A43B 5/00* (2013.01); *A43B 5/12* (2013.01); *A43B 13/223* (2013.01); *A43B 23/087* (2013.01)

(58) Field of Classification Search
CPC ..... A43B 5/12; A43B 13/223; A43B 23/087; A43B 5/003; A43B 5/00; A43B 5/02; A43B 5/06; A43B 13/12; A43B 13/187
USPC ..... 36/113, 114, 7.1 R–7.6, 103, 28
See application file for complete search history.

(56) References Cited

U.S. PATENT DOCUMENTS

| | | | | |
|---|---|---|---|---|
| 5,600,901 | A | 2/1997 | Leonar | |
| D436,245 | S | 1/2001 | Krussman | |
| 7,076,890 | B2 * | 7/2006 | Grove et al. | 36/15 |
| 7,140,129 | B2 * | 11/2006 | Newson et al. | 36/100 |
| 7,325,336 | B2 * | 2/2008 | Yamashita et al. | 36/102 |
| 7,578,076 | B2 * | 8/2009 | Pawlus et al. | 36/100 |
| 7,631,440 | B2 * | 12/2009 | Keen et al. | 36/50.1 |
| 8,474,155 | B2 * | 7/2013 | McDonald et al. | 36/102 |

* cited by examiner

*Primary Examiner* — Jila M Mohandesi
(74) *Attorney, Agent, or Firm* — LaMorte & Associates, P.C.

(57) ABSTRACT

A shoe assembly that enables a person to wear a wresting shoe or similar athletic shoe that has no cushioning material in its sole, and selectively attach an overshoe that has highly padded soles. In this way, an athlete can comfortably train on and off padded surfaces without having to change shoes. The athletic shoe has a first sole, a first toe section and a first heel section, wherein the first sole has surfaces with contoured shapes. An overshoe is provided that defines an interior sized to exactly receive a portion of the athletic shoe therein. The overshoe has surfaces that engage the contoured shapes of the wrestling shoe surfaces. This prevents the athletic shoe from moving within the overshoe. The sole of the overshoe is padded. In this manner, an athlete can add or remove padding from the shoe assembly by adding or removing the overshoe.

5 Claims, 3 Drawing Sheets

WRESTLING SHOE ASSEMBLY THAT INCLUDES AN AUXILIARY OVERSHOE

RELATED APPLICATIONS

This application is a continuation-in-part of provisional patent application No. 61/431,399, entitled "Product For Converting A Wrestling Shoe Into A Running Shoe", filed Jan. 10, 2011.

BACKGROUND OF THE INVENTION

1. Field of the Invention

In general, the present invention relates to the structure of athletic shoes. More particularly, the present invention relates to shoe systems that include a primary athletic shoe and a secondary overshoe that can be selectively attached to the athletic shoe.

2. Prior Art Description

Many different sports have athletic shoes that are specifically designed for use within that sport. Wrestling is no exception. Wrestling shoes are made to be as lightweight and as flexible as possible, while still being able to provide support to the wrestler's ankles. What is most unique about wrestling shoes is that they contain little or no padding along the heel and toe of the shoe. In this manner, a wrestler can feel as though he is barefoot and can have great stability and traction against the soft matting of the wrestling mat.

Although wrestling shoes have many benefits when worn on the soft padding of a wrestling mat, such shoes have many disadvantages when worn on surfaces other than that of the wrestling mat.

Since wrestling shoes have little or no padding along the sole and heel, wrestling shoes provide very little shock absorption when worn on a hard surface, such as a wooden gymnasium floor. Accordingly, if a wrestler skips rope, jogs, or otherwise warms up off the wrestling mat, the wrestler exposes his muscles, bones, and joints to unpadded impact forces that can easily cause discomfort or even injury. Likewise, during wrestling practices, when a coach may instruct a wrestler to run laps, or run drills on the hard gymnasium floor, the wrestler increases his chance of injury by wearing wrestling shoes.

Of course, a wrestler may change between wrestling shoes and training shoes whenever a wrestler enters and leaves a wrestling mat. However, this is highly impractical. During practice, a wrestler may enter and leave the padded wrestling mat numerous times. Likewise, during a meet, wrestlers often warm up after having already changed into their wrestling equipment. Having to stop to change shoes between the warm-up and the match is highly inconvenient.

In the prior art, there have been many auxiliary shoes that have been designed to cover athletic shoes. For example, U.S. Pat. No. D436,245 to Krussman, entitled Athletic Shoe Cover, discloses an auxiliary shoe cover that protects an athletic shoe from water and dirt. U.S. Pat. No. 5,600,901 to Leonor, entitled Spike Convertible Sport Shoe discloses an auxiliary shoe that adds golfing spikes to the bottom of an athletic shoe. Furthermore, there are many auxiliary shoes in the prior art for covering and protecting the spikes of golf shoes and other athletic shoes so that these shoes can be worn indoors.

However, in the prior art, no shoe system has been found where a wrestling shoe with no sole padding is provided with an auxiliary cover that is padded in the manner of a training shoe. In this manner, an athlete can wear only the wrestling shoe when on the wrestling mat and both the wresting shoe and its auxiliary cover when off the wrestling mat. This improved shoe system is described and claimed below.

SUMMARY OF THE INVENTION

The present invention is a shoe assembly that enables a person to wear a wresting shoe or similar athletic shoe that has no cushioning material in its sole, and selectively attach an overshoe that has highly padded soles. In this way, an athlete can comfortably train on and off padded surfaces without having to change shoes.

The athlete is provided with an athletic shoe. The athletic shoe has a first sole, a first toe section, and a first heel section, wherein the first sole has a bottom surface with a contoured shape.

An overshoe is provided that defines an interior. The interior is sized to exactly receive a portion of the athletic shoe therein. The overshoe has a second toe section, a second heel section, and a second sole. The second sole has a top surface within the interior that contacts the bottom surface of the first sole along all of the contoured shape. This prevents the athletic shoe from moving within the overshoe. The sole of the overshoe is padded. In this manner, an athlete can add or remove padding from the shoe assembly by adding or removing the overshoe.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention assembly can be used for athletic shoes other than wrestling shoes, the present invention is especially well suited for use with wrestling shoes. Accordingly, the embodiment of the present invention selected for illustration depicts the assembly in use with a wrestling shoe. This embodiment is selected in order to set forth the best mode contemplated for the invention. The illustrated embodiment, however, is merely exemplary and should not be considered a limitation when interpreting the scope of the appended claims.

Figure 1:
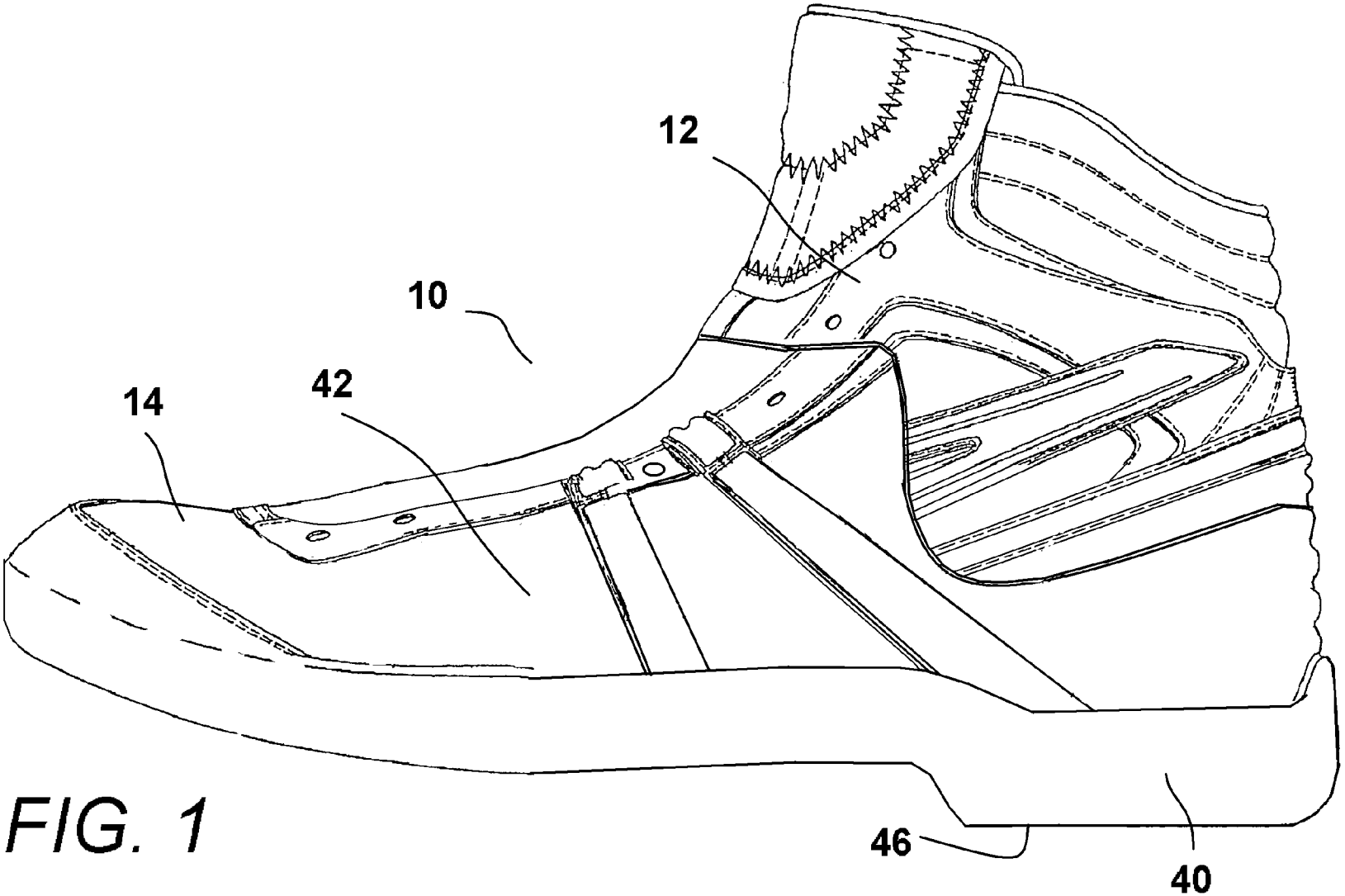
FIG. 1 is a side view of a shoe assembly containing an athletic shoe and an overshoe.
Figure 2:
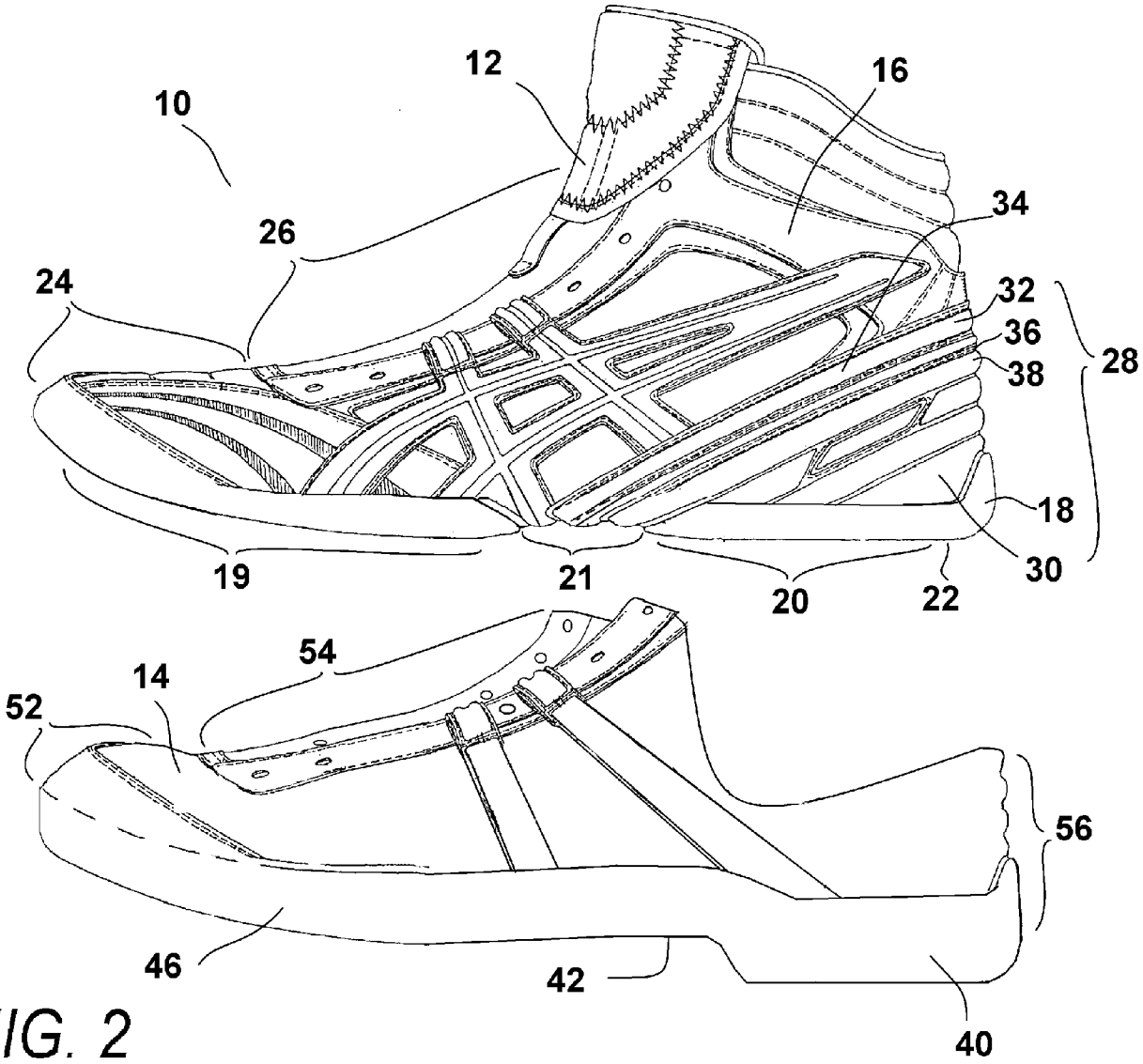
FIG. 2 is an exploded view of the assembly shown in FIG. 1.
Figure 3:
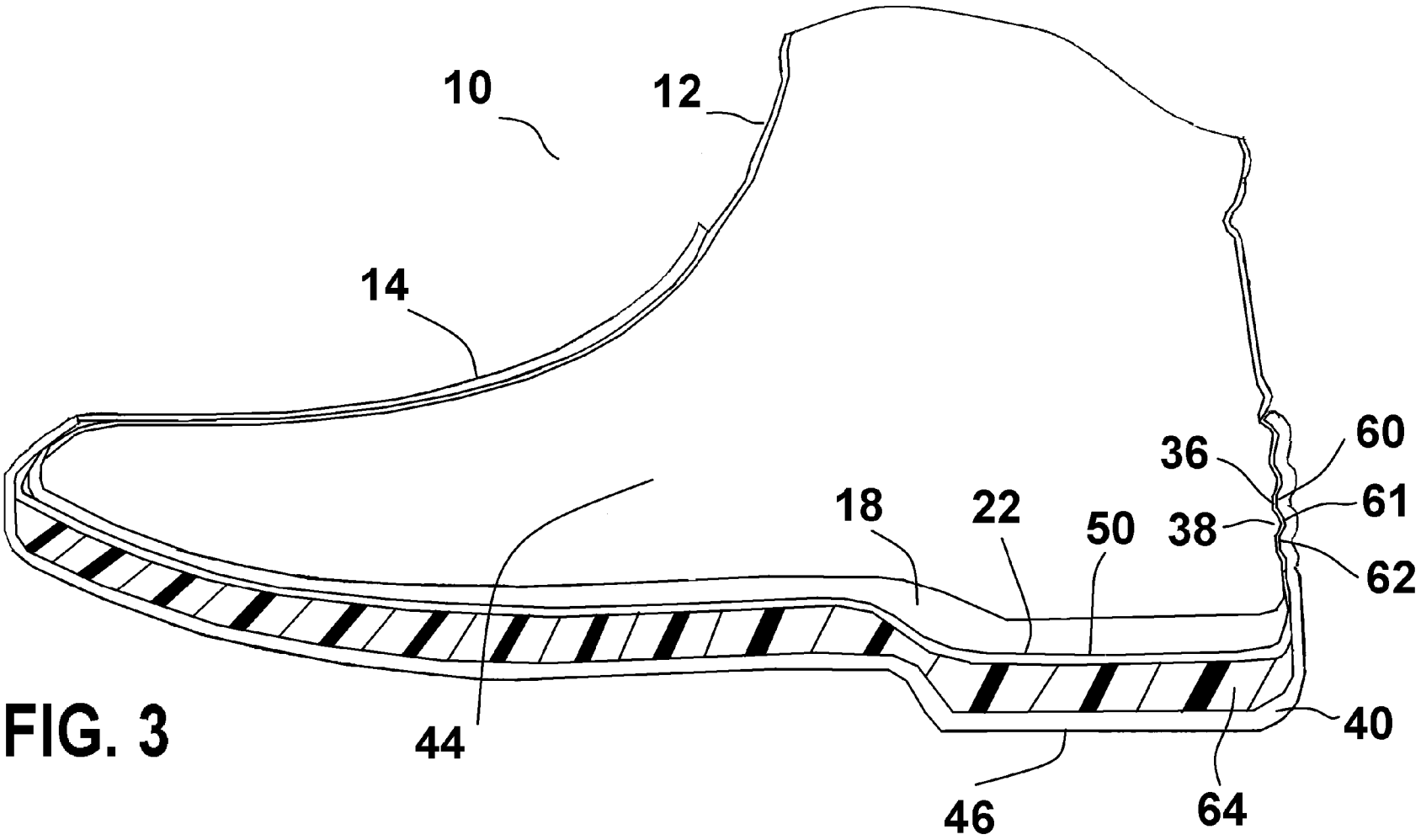
FIG. 3 is a cross-sectional view of the assembly shown in FIG. 1.

Referring in unison to FIG. 1, FIG. 2 and FIG. 3, an assembly 10 is shown that includes a wrestling shoe 12 and an auxiliary overshoe 14. The wrestling shoe 12 can have many different designs and embodies the primary features of a traditional wrestling shoe. That is, the wrestling shoe 12 has a high upper 16 that protects the foot and ankle of a wrestler. The shoe upper 16 is attached to a nearly flat sole 18 that has little or no padding. The sole 18 of the wrestling shoe has a ball section 19, a heel section 20 and an arch section 21 that separates the heel section 20 from the ball section 19. The ball section 19, heel section 20 and arch section 21 of the sole 18 combine with any tread pattern on the bottom surface 22 of the sole 18 to provide the bottom surface 22 of the sole 18 with a contour profile.

The wrestling shoe upper 16 has a toe section 24, a closure section 26 and a heel section 28. The heel section 28 has an exterior surface 30 that is not smooth. Rather, the exterior surface 30 of the heel section 28 contains discrete protrusions 32. The protrusions 32 are preferably part of reinforcement strapping 34 formed into the design of the wresting shoe 12. The protrusions 32 create a series of troughs 36 and crests 38 that present no hazard to an opposing wrestler who may contact these elements. However, the troughs 36 and crests 38 are sufficient to create half a mechanical connection, as will later be explained.

The wresting shoe 12 is worn on the foot of the wrestler in the traditional manner. Accordingly, the wrestling shoe 12 is sized in the traditional manner to fit onto a wrestler's foot. The auxiliary overshoe 14, however, is not meant to be worn directly on a person's foot. Rather, the auxiliary overshoe 14 is sized to receive and retain the wrestling shoe 12. It will therefore be understood that when worn, the wrestling shoe 12 is interposed between the wrestler's foot and the auxiliary overshoe 14.

The auxiliary overshoe 14 also has a sole 40 and an upper 42. The sole 40 and the upper 42 define an interior 44 that is sized to receive the wrestling shoe 12 leaving little or no gap spaces between the wrestling shoe 12 and the surrounding overshoe 14. The sole 40 of the overshoe 14 has a bottom surface 46 with treads. The sole 40 of the auxiliary overshoe 14 also has a top surface 50 that is exposed within the interior 44 of the auxiliary overshoe 14. The top surface 50 of the sole 40 is not shaped to receive a foot. Rather, the top surface 50 is shaped into the negative of the contour profile of the bottom surface 22 of the wrestling shoe sole 18. In this manner, when the wrestling shoe 18 is set inside the auxiliary overshoe 14, the bottom surface 22 of the wrestling shoe sole 18 intermeshes with the top surface 50 of the overshoe sole 40, leaving no gaps between these two surfaces 22, 50. The intermeshing of these two surfaces 22, 50 prevent the wresting shoe from moving within the interior 44 of the auxiliary overshoe 14. Since the sole 18 of the wrestling shoe 12 engages the sole 40 of the auxiliary overshoe 14, the two soles 22, 50 act as a single unit when worm on a wrestler's foot.

The upper 42 of the auxiliary overshoe 14 also has a toe section 52, a closure section 54 and a heel section 56. The toe section 52 of the auxiliary overshoe 14 is sized and shaped to receive the toe section 24 of the wresting shoe 12. The closure section 54 of the auxiliary overshoe 14 is longer than that of an ordinary shoe and extends well down near the toe of the overshoe 14. This enables the closure section 54 to be opened extra wide, therein enabling the wrestling shoe 12 to pass easily both into and out of the auxiliary overshoe 14. The closure section 54 can be closed with laces. However, to expedite the quick attachment and detachment of the overshoe 14, it is preferred that the closure section 54 of the auxiliary overshoe 14 be closable by a more rapid closure device, such as Velcro tabs, elastic bands or a zipper.

The heel section 56 of the auxiliary overshoe 14 has a contoured interior surface 60 that mimics the shape of the exterior surface 30 of the heel section 28 of the wrestling shoe 12. Accordingly, the interior surface 60 of the overshoe 14 has depressions 61 and protrusions 62 that interconnect with the contour profile on the exterior surface 30 of the heel section 20 of the wrestling shoe 12. The presence of the depressions 61 and protrusions 62 would make the auxiliary overshoe 14 rather uncomfortable if it were worn directly as a shoe on the foot. However, since the auxiliary overshoe 14 is worn over the wrestling shoe 12, the presence of the depressions 61 and protrusions 62 has no effect upon comfort.

The interior 44 defined by the auxiliary overshoe 14 is sized exactly to match the exterior of the wrestling shoe 12. In this manner, when the wrestling shoe 12 is placed within the overshoe 14, there are no gaps between these parts that allow for independent movement. The wrestling shoe 12 and the overshoe 14, therefore, act together as single shoe.

In order to attach the auxiliary overshoe 14 to the wrestling shoe 12, the closure section 54 of the auxiliary overshoe 14 is opened to its widest extent. The wrestling shoe 12 is then inserted into the auxiliary overshoe 14 as though one were stepping into a large slipper. As the wrestling shoe 12 enters the auxiliary overshoe 14, the toe section 24 of the wresting shoe 12 passes into the toe section 52 of the auxiliary overshoe 14. The sole 18 of the wresting shoe 12 intermeshes with the sole 40 of the auxiliary overshoe 14. Furthermore, the heel section 20 of the wresting shoe 12 contacts and interlocks with the heel section 56 of the auxiliary overshoe 14. That is, the troughs 36 and crests 38 formed on the exterior surface 30 of the wrestling shoe heel section 28 intermesh with the projections 62 and depressions 61 on the heel section 56 of the auxiliary overshoe 14. This creates a positive interconnection that prevents the heel section 28 of the wrestling shoe 12 from inadvertently pulling up and out of the heel section 56 of the auxiliary overshoe 14.

It will therefore be understood that when the wrestling shoe 12 is positioned within the auxiliary overshoe 14 and the closure section 54 of the auxiliary overshoe 14 is closed, then the toe section 52 of the auxiliary overshoe 14 is securely affixed over the toe section 24 of the wrestling shoe 12. Likewise, the heel section 20 of the wrestling shoe 12 is interlocked with the heel section 56 of the auxiliary overshoe 14. Lastly, the sole 18 of the wrestling shoe 12 is intermeshed with the sole 40 of the auxiliary overshoe 14. The result is that the auxiliary overshoe 14 is firmly interlocked with the wrestling shoe 12 and the wrestling shoe 12 cannot move in any direction independently from the auxiliary overshoe 14. Consequently, the wrestling shoe 12 and the auxiliary overshoe 14 combine to become a training shoe assembly 10.

The auxiliary overshoe 14 contains cushioning 64 between the top surface 50 and the bottom surface 46 of its sole 40. This provides cushioning to the training shoe assembly 10 that the wrestling shoe 12 alone lacks. The cushioning 64 includes elastomeric foam material that is between 0.25 inches and 1.0 inches thick in an area under the heel, and between 0.25 inches and 0.50 inches thick in an area under the ball of the foot. A wrestler can therefore quickly and easily attach the auxiliary overshoe 14 to his wrestling shoe 12 any time the wrestler leaves the wrestling mat. The wrestling shoe 12 with the attached auxiliary overshoe 14 now serves as a fully padded athletic training shoe assembly 10 that is appropriate for running and other high-impact activities on hard surfaces. The wrestler can therefore run and train on hard surfaces in greater comfort and with reduced chances of injury. However, whenever the wrestler chooses to step onto the wrestling mat, the wrestler need only loosen the auxiliary overshoe 14 and step out of the auxiliary overshoe 14 as easily as someone can step out of a slipper.

It will be understood that the embodiment of the present invention that is illustrated and described is merely exemplary and that a person skilled in the art can make many variations to that embodiment. For instance, the appearance of the wresting shoe and the auxiliary overshoe can be varied as a matter of design choice. All such embodiments are intended to be included within the scope of the present invention as defined by the claims.

What is claimed is:

1. A shoe assembly comprising:

a wrestling shoe having a first sole that is unpadded, a first toe section and a first heel section, said first heel section extending upwardly from the sole, said heel section having an exterior surface, wherein said exterior surface of said first heel section contains a first set of protrusions and depressions that creates a first pattern of troughs and crests on said exterior surface of said first heel section, and wherein said first sole has a bottom surface with a contoured shape;

an overshoe defining an interior that is sized to exactly receive a portion of said wrestling shoe therein, said overshoe having a second toe section, a second heel section and a second sole with padding material, wherein said second heel section extends upwardly from said second sole, wherein said second heel section has a second set of protrusions and depressions that create a second pattern of troughs and crests within said interior that intermeshes with said first pattern of troughs and crests on said first heel section of said wrestling shoe, therein creating a mechanical interconnection between said wrestling shoe and said overshoe, and wherein said second sole has a top surface within said interior that contacts said bottom surface of said first sole along all of said contoured shape; and wherein said second sole contains a tread surface and said padding material is interposed between said tread surface and said top surface.

2. The assembly according to claim 1, wherein said top surface of said second sole mimics said contoured shape of said bottom surface of said first sole, leaving no gaps between said first sole and said second sole when said wrestling shoe is seated within said overshoe.

3. The assembly according to claim 1, wherein said padding material interposed between said tread surface and said top surface includes at least 0.25 inches of elastomeric foam.

4. A shoe assembly comprising:

an athletic shoe having a first sole that is unpadded and nearly flat, wherein said athletic shoe further includes a first heel section that extends upwardly from said first sole, said first heel section having an exterior surface, wherein said exterior surface of said first heel section contains a first set of protrusions and depressions that create a first pattern of troughs and crests on said exterior surface;

an overshoe defining an interior that is sized to receive said athletic shoe therein, wherein said overshoe has a second heel section that extends upwardly from a second sole, wherein said second sole abuts flush against said first sole of said athletic shoe, and wherein said second sole positions at least 0.25 inches of padding material under said first sole when said athletic shoe is fully seated within said overshoe, and wherein said second heel section has a second set of protrusions and depressions that create a second set of troughs and crests on said second heel section that intermeshes with said first pattern of troughs and crests on said first heel section of said athletic shoe, therein creating a mechanical interconnection between said athletic shoe and said overshoe.

5. The assembly according to claim 4, wherein said first sole has a contoured shape and said second sole mimics said contoured shape of said first sole, leaving no gaps between said first sole and said second sole when said first sole abuts against said second sole.

* * * * *